US008929579B2

(12) United States Patent
Kalyuzhny et al.

(10) Patent No.: US 8,929,579 B2
(45) Date of Patent: Jan. 6, 2015

(54) SPEAKER AND MIXER ASSEMBLY

(75) Inventors: Val Kalyuzhny, Reseda, CA (US); Tim Nugent, Santa Monica, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 381 days.

(21) Appl. No.: 13/271,010

(22) Filed: Oct. 11, 2011

(65) Prior Publication Data

US 2012/0099750 A1 Apr. 26, 2012

Related U.S. Application Data

(60) Provisional application No. 61/391,792, filed on Oct. 11, 2010.

(51) Int. Cl.

| | |
|---|---|
| ***H04R 1/02*** | (2006.01) |
| ***H04R 3/00*** | (2006.01) |
| *H04R 27/00* | (2006.01) |
| *H04R 3/12* | (2006.01) |

(52) U.S. Cl.

CPC ..... *H04R 3/00* (2013.01); *H04R 2430/01* (2013.01); *H04R 27/00* (2013.01); *H04R 3/12* (2013.01); *H04R 2420/01* (2013.01)

USPC ..... 381/334; 381/332; 381/87; 381/386

(58) Field of Classification Search

CPC ..... H04R 1/02

USPC ..... 381/87, 334, 361, 366, 386

See application file for complete search history.

(56) References Cited

U.S. PATENT DOCUMENTS

| | | | | |
|---|---|---|---|---|
| 5,933,507 | A | 8/1999 | Woolley et al. | |
| 7,804,966 | B2 * | 9/2010 | Adams et al. | 381/87 |
| 2003/0174855 | A1 * | 9/2003 | Hawkins et al. | 381/386 |
| 2006/0280326 | A1 * | 12/2006 | Stevens et al. | 381/386 |
| 2007/0223745 | A1 * | 9/2007 | Feng et al. | 381/160 |
| 2009/0034771 | A1 * | 2/2009 | Gleissner et al. | 381/332 |

* cited by examiner

*Primary Examiner* — Disler Paul

(74) *Attorney, Agent, or Firm* — Brooks Kushman P.C.

(57) ABSTRACT

A transportable audio system is described. The transportable audio system may include a speaker module and speaker mating module. The speaker module may include a backside mating edge and a backside interior inset from the backside mating edge. The backside mating edge may include a first attachment mechanism. The speaker mating module may include a frontside mating edge and a frontside face. The frontside mating edge may include a second attachment mechanism. The speaker mating module may be removably mountable to the speaker module via the first and second attachment mechanisms.

8 Claims, 8 Drawing Sheets

9A

9C

9B

9D

SPEAKER AND MIXER ASSEMBLY

CROSS-REFERENCE TO RELATED APPLICATION

This application the claims priority of U.S. Provisional Patent Application No. 61/391,792 titled SPEAKER AND MIXER ASSEMBLY, filed on Oct. 11, 2010, which is incorporated by reference in its entirety in this application.

BACKGROUND OF THE INVENTION

1. Field of Invention

This disclosure generally relates to performance audio equipment. More specifically, this disclosure relates to an integrated speaker and mixer assembly.

2. Related Art

Audio performance equipment includes various components, such as speakers, microphones, amplifiers, mixing consoles, or mixers, interconnecting cables and various other accessories. These components are in addition to the equipment that is the source of the audio sound. The idea of an audio performance is not limited to musical performances, such as by a touring band, but also includes any audio performance where sound reproduction and projection might be needed. These audio performances can include conference presentations, theatrical plays, church sermons, graduation ceremonies, political speeches, symphonies, movie showings, sports announcers, and hundreds of other audio performance types.

Audio performance equipment should reproduce the sound at acceptable levels of quality and project the sound at acceptable volume levels for the intended audience to enjoy. In addition to these acceptable levels of sound reproduction and projection, some uses of audio components might require ease of transportation from one performance to the next and ease of set-up and tear-down at each performance venue.

Transportation considerations can include the physical dimensions of the equipment, the weight of the equipment and the durability of the equipment. The physical dimensions of the equipment can affect the ability to fit or pack the equipment in storage containers, to fit the equipment into various transport types (e.g., planes, trains, buses, autos, etc.), and to configure the equipment at differing venue types (e.g., stages, amphitheaters, schools, churches, etc.). The weight of the equipment can affect the cost and ability to transport and set-up the equipment. The durability of the equipment can affect in what environments the equipment can be used (e.g., heat, cold, rain, etc.), as well as the life expectancy of the equipment.

For example, in a school gymnasium it may be desirable to set speakers on the floor, with a mixer immediately adjacent to them. On an amphitheater stage it may be desirable to mount the speakers on the stage at various heights, using stands or suspension systems, but with the mixer set a distance away from the stage. Additionally, in a school gym, the environmental conditions are likely controlled, whereas on an amphitheater stage it could be raining or sunny, very hot or very cold.

Therefore, there is a need for performance audio equipment that satisfies the desired audio reproduction and projection levels, as well as the desired transportation considerations.

SUMMARY

A transportable audio system is described. The transportable audio system may include a speaker module and speaker mating module. The speaker module may include a backside mating edge and a backside interior inset from the backside mating edge. The backside mating edge may include a first attachment mechanism. The speaker mating module may include a frontside mating edge and a frontside face. The frontside mating edge may include a second attachment mechanism. The speaker mating module may be removably mountable to the speaker module via the first and second attachment mechanisms.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. In the figures, like reference numerals designate corresponding parts throughout the different views.

DETAILED DESCRIPTION

In the following description of the preferred embodiment, reference is made to the accompanying drawings that form a part hereof, and in which is shown by way of illustration a specific embodiment in which the invention may be practiced. It is to be understood that other embodiments may be utilized and structural changes may be made without departing from the scope of this invention.

Specifically, reference is now made to certain implementations in accordance with the invention, examples of which are illustrated in the accompanying drawings. For clarity, corresponding features are consistently labeled across the various views provided in the figures.

Described is a transportable audio system including a speaker module and a speaker mating module. In certain examples of implementations, the speaker mating module may be mixer and the transportable audio system may be designed into a single, separable, integrated package, which may be portable, as shown in FIGS. 9A-9D. It will become apparent to those skilled in the art upon reading this disclosure that many similar speaker/mixer designs, combinations and packages are possible. All of these designs, combinations and packages are intended to be within the scope of this application.

As an example of an implementation, the speaker module may include a backside mating edge and backside interior which extends inward into the speaker module from the backside mating edge. The backside mating edge may include a first attachment mechanism such as a latch or, alternatively, a hook plate capable of physically coupling to a latch.

The speaker mating module may be a housing that includes a cavity for storage of cables and/or other components or it may be a housing that includes an audio mixer. The speaker mating module may also include a frontside mating edge and a front face where the frontside mating edge may include a second attachment mechanism. In this example, the speaker mating module may be removably mountable to the speaker module via the first and second attachment mechanisms.

Figure 1:
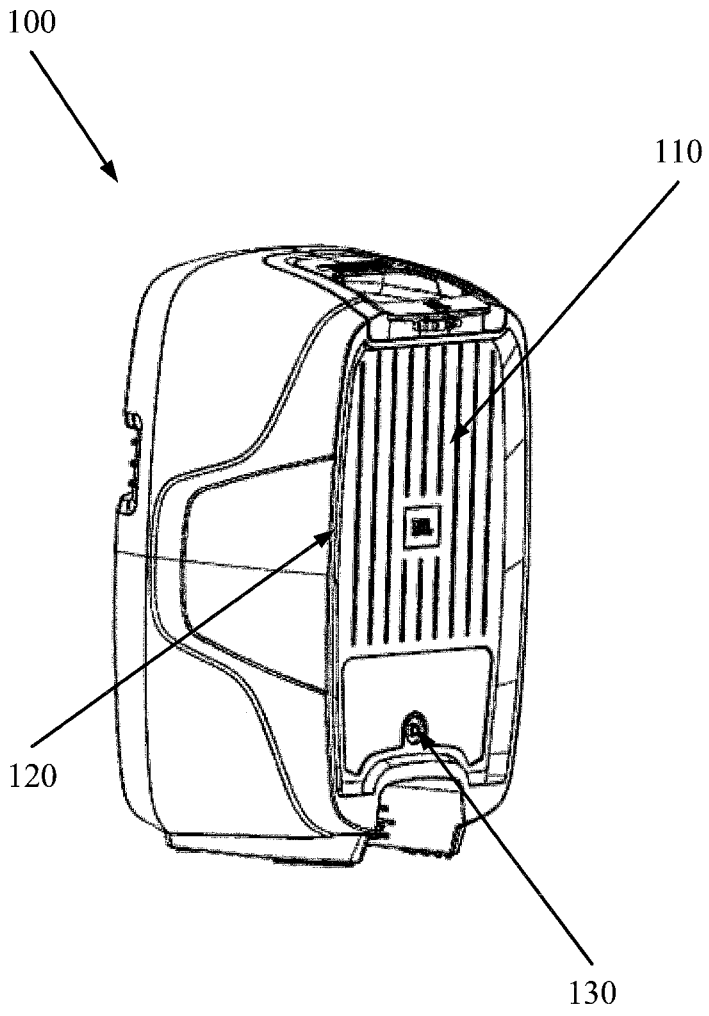
FIG. 1 is a perspective back view of an example of an implementation of a speaker in accordance with the invention.

Turning to FIG. 1, a perspective front view of an example of an implementation of a speaker module 100 is shown in accordance with the invention. The speaker module 100 may include various internal components (not shown) for reproducing an audio input signal. The various internal components may include one or more drivers (e.g., sound transducers such as woofers, tweeters, mid-ranges, etc.), audio signal inputs, passive or active audio filters, audio crossovers, electrical power inputs and rectifiers, and audio amplifiers. The speaker module 100 may also include various connectors for receiving electrical power (not shown) and one or more speaker audio inputs 130.

The speaker module 100 may be of any size or shape, for example, 18 inches to 30 inches in height, 10 inches to 20 inches in width and 8 inches to 18 inches in depth. The speaker module 100 may include a speaker module backside interior 110 and a speaker module backside mating edge 120. The speaker module backside interior 110 may provide a back structural and/or environmental surface for the speaker module 100. The speaker module backside interior 110 may also provide an acoustic back wall for the speaker module 100. The speaker module backside mating edge 120 may include means for environmental sealing the speaker module 100, such as a seal or O-ring, or other physically equivalent structures (not shown). The speaker module backside interior 110 may be an inset as compared to speaker module backside mating edge 120. For example, the speaker module backside interior 110 may be inset by an amount approximately 0.25 inches, or a little less, to as much as about 2 inches, depending on the dimensions of speaker module 100 and the mating requirements for any add-on backing (not shown). In general, the inset amount of the speaker module backside interior 110 is chosen such that the overall structural, environmental and acoustic characteristics of speaker module 100 remain satisfactory as compared to a similarly sized speaker made without the inset of speaker module backside interior 110. As an example, the speaker module 100 may not be a powered device and may be approximately 19 inches in height, 12 inches in width, and 8 inches in depth, with the speaker module backside interior 110 being inset approximately 0.5 inches from speaker module backside mating edge 120.

Figure 2:
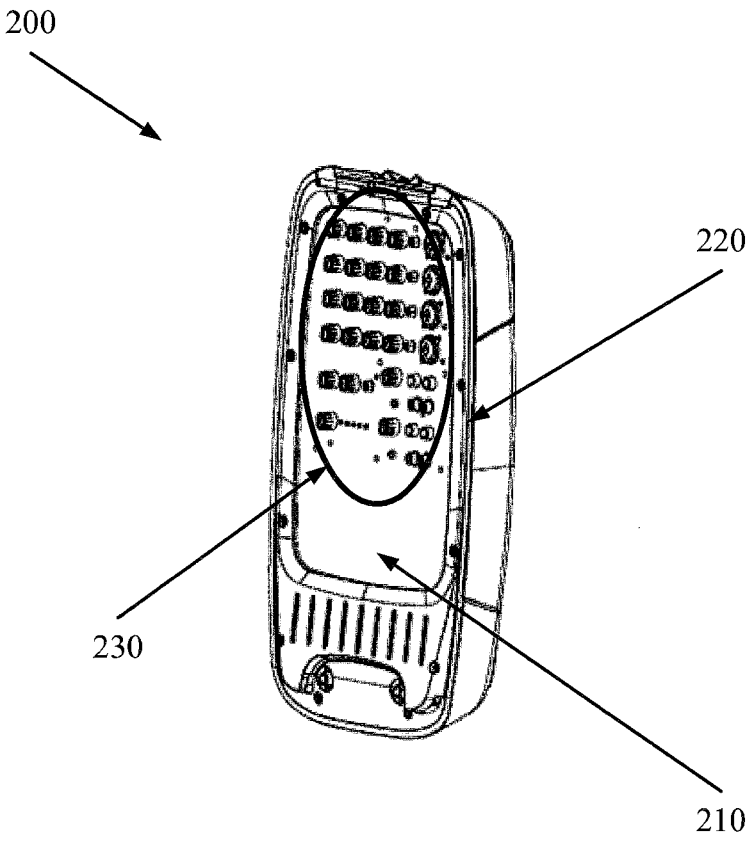
FIG. 2 is a perspective front view of an example of an implementation of a mixer in accordance with the invention.

In FIG. 2, a perspective side-view of an example of an implementation of a speaker mating module 200 is shown. In this example, the speaker mating module 200 may include a mixer (also interchangeable used with a mixing console). The mixer in the speaker mating module 200 may include various internal components (not shown) to carry out one or more of the functions of audio mixing. These functions may include blending and controlling the volume of a number of input signals, adding audio effects, with or without processing, and routing the mixed audio signal to a destination (e.g., power amplifier, amplified speaker, recording device, etc.). The mixer may also internally include a power amplifier and digital signal processor, and an external connector for receiving electrical power (not shown).

In this example, the speaker mating module may include a frontside face 210 (in this example a mixer face) and a frontside mating edge 220. Similar to the speaker module backside mating edge 120, the frontside mating edge 220 may include means for environmental sealing, such as a seal or O-ring (not shown). The frontside face 210 may be inset as compared to the frontside mating edge 220, or the frontside face 210 may be substantially in the same plane as frontside mating edge 220. The frontside face 210 may include various electrical connectors, switches and knobs 230 for inputting and outputting one or more audio signals and for controlling the mixing functionality. The various electrical connectors, switches and knobs 230 may extend outward from the frontside face 210 by an amount that may be greater than, equal to or less than the amount the frontside face 210 is inset from the frontside mating edge 220. As an example in the case of a mixer, the electrical connectors, switches and knobs 230 may extend outward from mixer face (frontside face 210) by less than approximately 1 inch, with the frontside face 210 being inset by approximately 0.25 inches from the frontside mating edge 220. Also as an example, the speaker mating module 200 may include an external connector for receiving electrical power, a power amplifier and a digital signal processor.

The speaker mating module 200 may be designed such that the dimensions of frontside mating edge 220 substantially match the dimensions of speaker back mating edge 120, to facilitate assembling the speaker mating module 200 to the back of speaker 100. The speaker mating module 200 and speaker 100 may further include attachment means of various kinds, one of which is described in more detail, below. The speaker mating module 200 may be of a thickness as is necessary to include the necessary components and interconnections, for example, between about 1 inch and 4 inches in thickness. Alternatively, in another example, the speaker mating module 200 may be approximately 2.5 inches in thickness.

Figure 3:
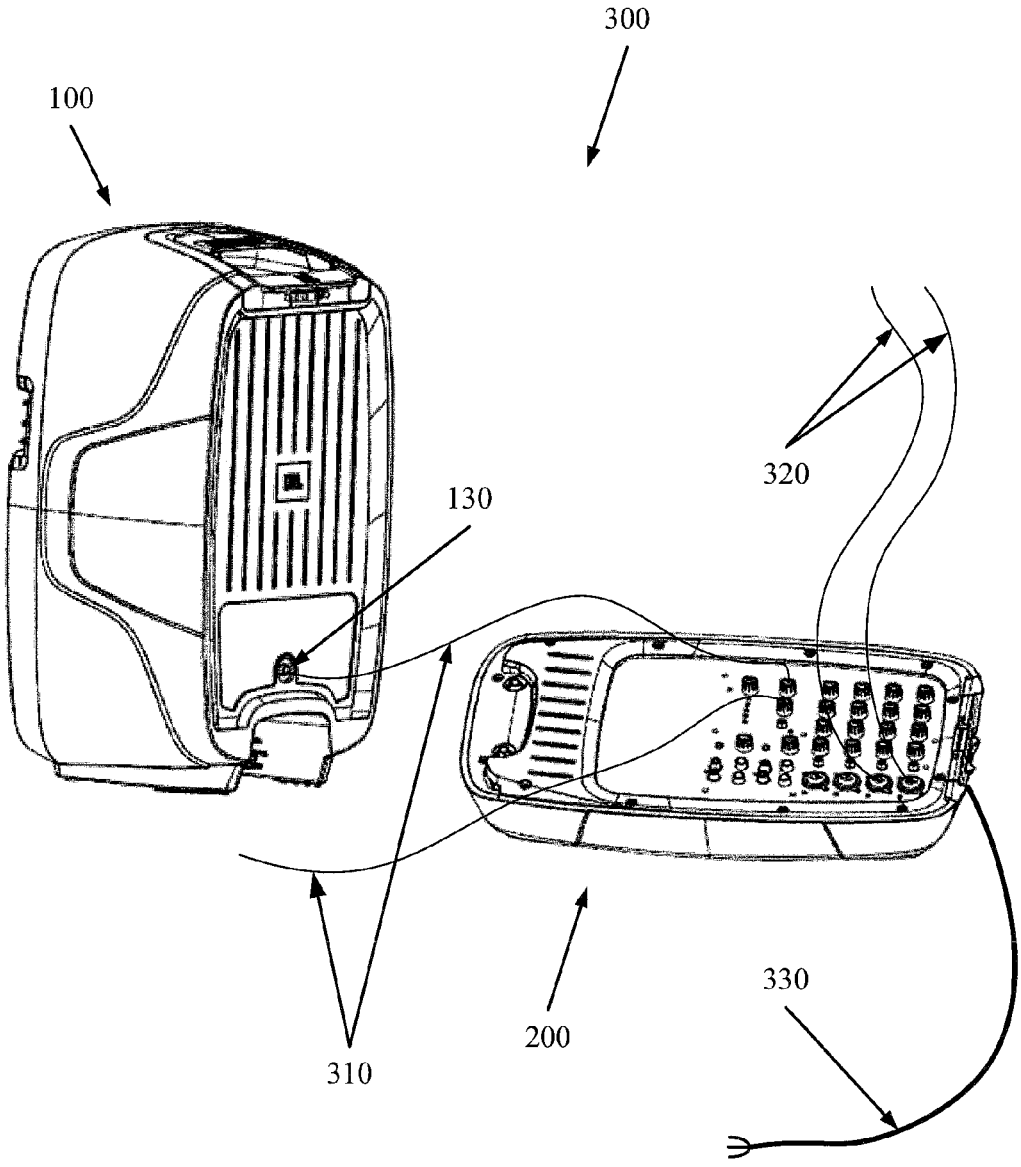
FIG. 3 is an assembly view of an example of an implementation of a transportable audio system having a speaker module, shown in FIG. 1, and a speaker mating module, shown in FIG. 2, in accordance with the invention.

Turning to FIG. 3, an assembly view of an example of an implementation of a transportable audio system 300 is shown having a speaker module 100 and a speaker mating module 200. As shown in this example, the speaker module 100 does not include a power input cable or power amplifier but the speaker mating module 200 does include a power supply connection 330 for supplying power to mixer. Power may be alternating current (at 110 or 220 volts), or direct current, e.g., from batteries. Alternatively, the speaker mating module 200 may include internal batteries. The speaker mating module 200 may also include one or more audio input connections 320, though which the mixer of the speaker mating module 200 receives various audio inputs from, e.g., a microphone, musical instrument(s), audio equipment, laptop, smart phone, and the like. As an example, the mixer of the speaker mating module 200 may include two or four input channels. The mixer of the speaker mating module 200 may also internally include a digital signal processor for manipulating the received audio inputs.

The mixer of the speaker mating module 200 may provide audio output signal(s) through one or more audio output connections 310. As shown in FIG. 3, an audio output connection 310 may be connected to the speaker module 100 via speaker audio input 130. As an example, mixer of the speaker mating module 200 may supply two audio output connections 310, which supply audio signals to two speakers (not shown). Using the example of the operational configuration shown in FIG. 3, the mixer of the speaker mating module 200 may receive one to four separation audio inputs. The mixer may amplify, mix and process the received audio inputs. The mixer of the speaker mating module 200 may then supply the resultant audio signal(s) to one or more speakers (not shown).

Figure 4:
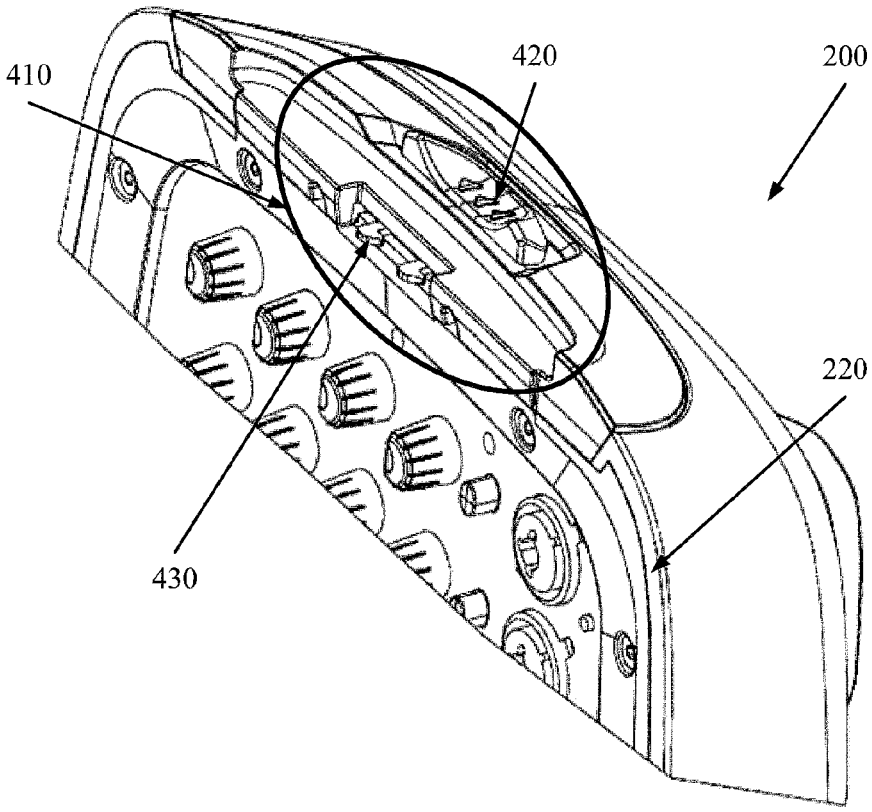
FIG. 4 is a perspective front view of an example of an implementation of a mixer top latch assembly in accordance with the invention.

In FIG. 4, an example of an implementation of a speaker mating module 200 top latch assembly 410 is shown in accordance with the invention. In this example, the speaker mating module 200 may include the speaker mating module 200 top latch assembly 410, which may be mounted on or within the top edge of the frontside mating edge 220 and roughly centered along the top edge of the frontside mating edge 220. As an example, the speaker mating module 200 top latch assembly 410 may include a top latch release 420 and speaker mating module 200 top latch hooks 430. The speaker mating module 200 top latch hooks 430 may be used to removably secure, or affix, speaker mating module 200 to the speaker module 100, for example, during storage or transportation. The speaker mating module top latch release 430 may be used to release the speaker mating module 200 top latch hooks 430 from speaker module 100, thereby allowing the speaker mating module 200 to be separated from the speaker module 100, for example, to facilitate operation. The speaker mating module 200 top latch hooks 430 may include one or more flat metal hooks that are spring loaded in a latched position, with speaker mating module top latch release capable of working against the spring loading to move the one or more flat metal hooks into an unlatched position.

Figure 5:
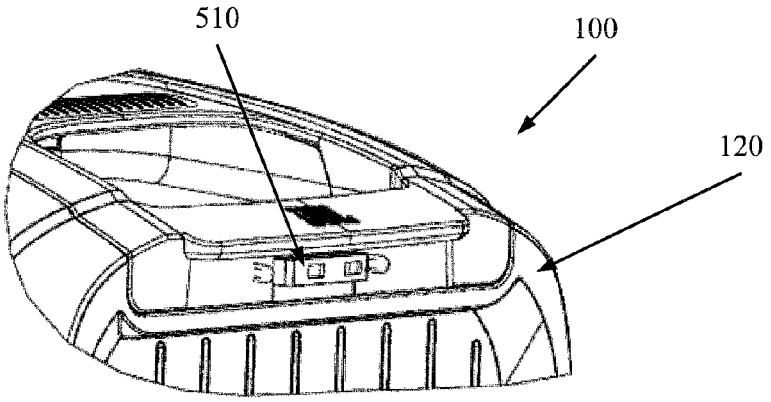
FIG. 5 is a perspective front view of an example of an implementation of a speaker top hook plate in accordance with the invention.

In FIG. 5, a speaker module 100 top hook plate 510 is shown in accordance with the invention. As shown in FIG. 5, the speaker module 100 may include speaker module 100 top hook plate 510, which may be mounted on or within the top edge of the speaker module 100 back mating edge 120. The speaker module 100 top hook plate 510 may be used, along with speaker mating module 200 top latch assembly 410, to removably secure, or affix, the speaker mating module 200 to the speaker module 100 by providing an attachment point, or points, for the speaker mating module 200 top latch hooks 430. The speaker module 100 top hook plate 510 may include a raised metal plate with one or more holes in it, into and against which the speaker module 100 top latch hooks may be latched (and subsequently unlatched).

Figure 6:
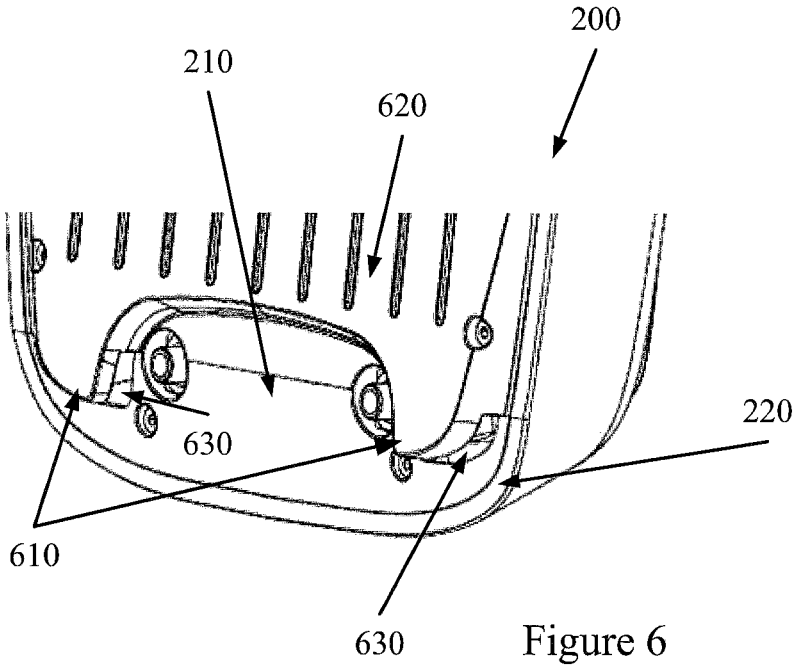
FIG. 6 is a perspective front view of an example of an implementation of mixer bottom tabs in accordance with the invention.

Turning to FIG. 6, one or more speaker mating module 200 bottom tabs 610 are shown in accordance with the invention. As shown in FIG. 6, the speaker mating module 200 may include a mixer bottom tab plate 620 as part of or separate from the frontside mating edge 220, which may be gradually inclined away from (e.g., protruding outwardly) the frontside mating edge 220, to create a separation of between about 0.25 inches and 1.5 inches. The base of the speaker mating module 200 bottom tab plate 620 may include the speaker mating module 200 bottom tabs, which may extend downward and be separated from the frontside face 210, providing gaps 630 between the frontside face 210 and the speaker mating module 200 bottom tabs of between about 0.25 inches and 1.25 inches. As an example, the speaker mating module 200 bottom tab plate 620 may be inclined approximately 0.8 inches away from frontside face 210, creating gaps of approximately 0.5 inches between speaker mating module 200 bottom tabs 610 and the frontside face 210.

Figure 7:
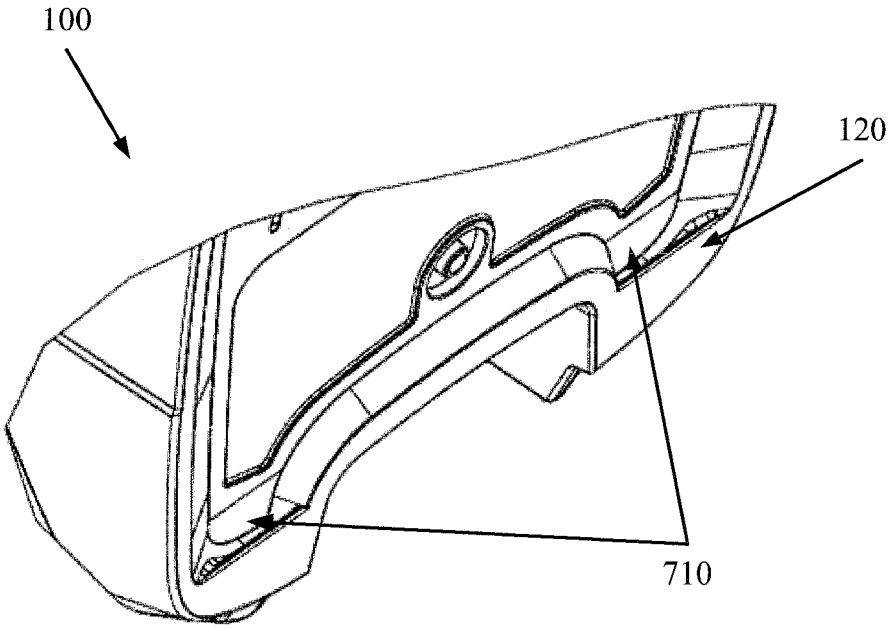
FIG. 7 is a perspective front view of an example of an implementation of speaker bottom tab slots in accordance with the invention.

FIG. 7 illustrates one or more the speaker module 100 bottom tab slots 710 in accordance with the invention. As shown in FIG. 7, the speaker module 100 may include one or more the speaker module 100 bottom tab slots 710, which may be inset to speaker module backside mating edge 120, at the base of the speaker module 100. The speaker module 100 bottom tab slots may be sized to provide a matched receptacle for mating with speaker module 100 bottom tabs 610.

Figure 8A:
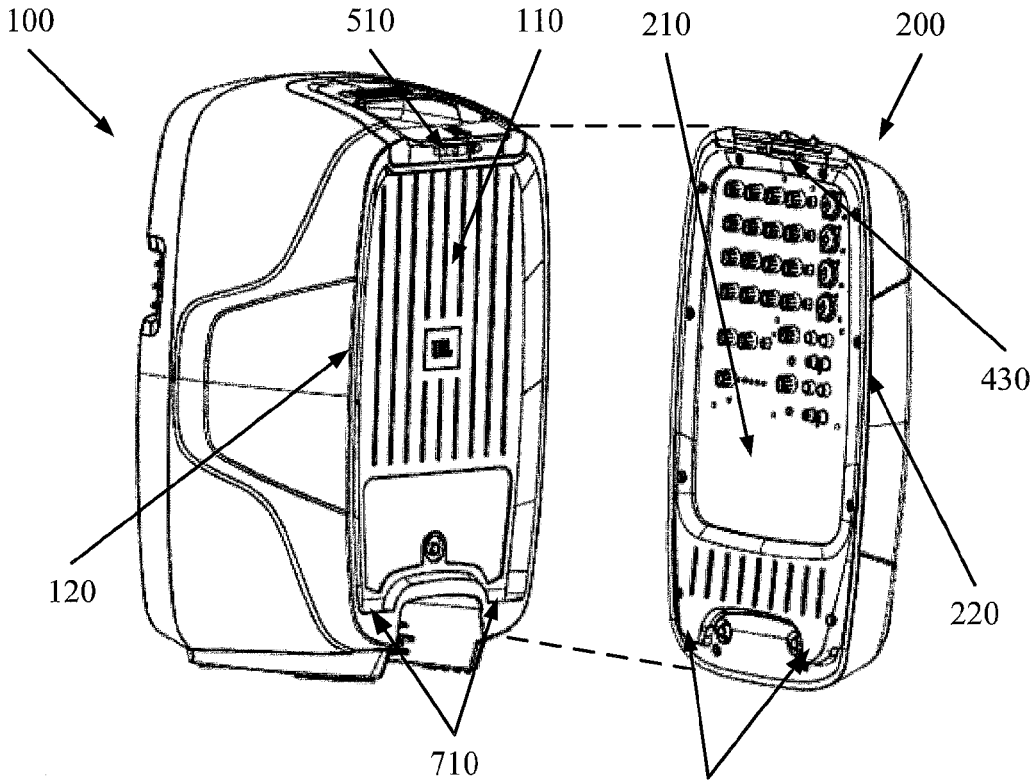
FIGS. 8A and 8B are assembly views of an example of an implementation of speaker and mixer shown in FIGS. 1, 2 and 3 in accordance with the invention.
Figure 8B:
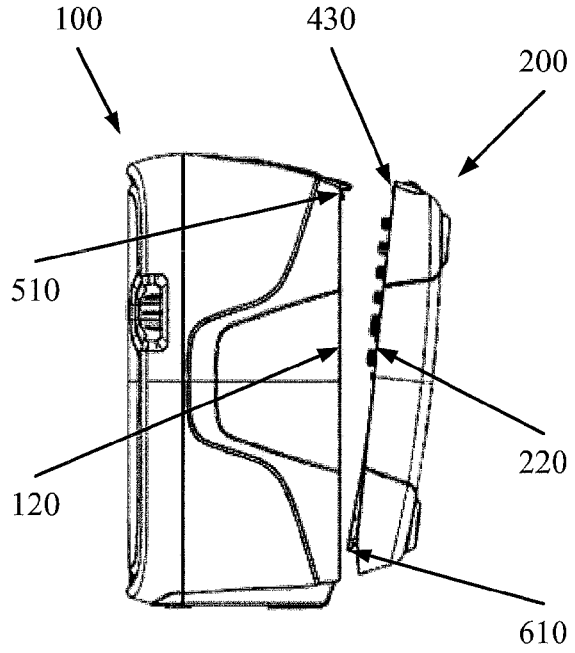

FIGS. 8A and 8B illustrate a transportable audio system (also known as a speaker-mixer assembly) in accordance with the invention. As shown in FIG. 8A, the speaker module 100 may be mated with speaker mating module 200 to form a speaker-mixer assembly (shown in FIGS. 9A-9D). When mating, speaker back interior 110 will be adjacent to frontside face 210. The speaker module backside mating edge 120 will be in contact with frontside mating edge 220. The speaker mating module 200 bottom tabs 610 will rest inside of and against speaker module 100 bottom tab slots 710, and speaker mating module 200 top latch hooks 430 will engage speaker module 100 top hook plate 510.

As shown in FIG. 8B, when mating speaker mating module 200 to speaker module 100, the bottom of speaker mating module 200 is installed first, with speaker mating module 200 bottom tabs 610 being lowered into and against speaker module 100 bottom tab slots (710 in FIGS. 7 and 8A) while the top of speaker mating module 200 is kept slight separated from the top of speaker module 100. After speaker mating module 200 bottom tabs 610 are inserted into and resting against speaker module 100 bottom tab slots (710 in FIGS. 7 and 8A), the top of speaker mating module 200 can be pressed against speaker 100, which will engage and secure mixer top latch hooks 430 into speaker top hook plate 510. When removably secured in this manner, speaker module backside mating edge 120 will be in contact with mixer mating edge 200. To remove speaker mating module 200 from speaker module 100, speaker mating module 200 top latch release (420 in FIG. 4) may be moved to disengage speaker mating module 200 top latch hooks 430 from speaker module 100 top hook plate 510, followed by lifting speaker mating module 200 upward and outward to remove speaker mating module 200 bottom tabs 610 from speaker bottom tab slots (710 in FIGS. 7 and 8A).

Figure 9A:
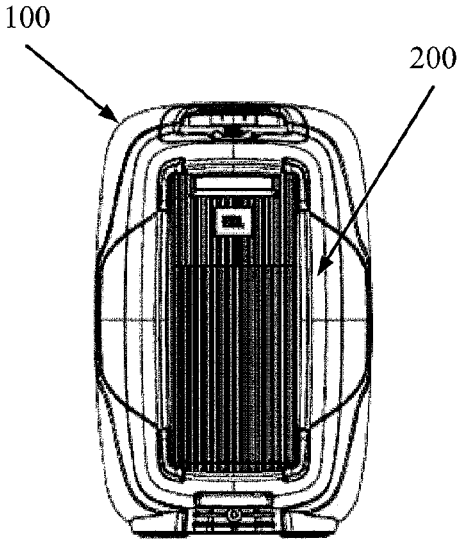
FIGS. 9A-9D are assembled views of an example of an implementation of speaker and mixer shown in FIGS. 1 and 2 in accordance with the invention.
Figure 9B:
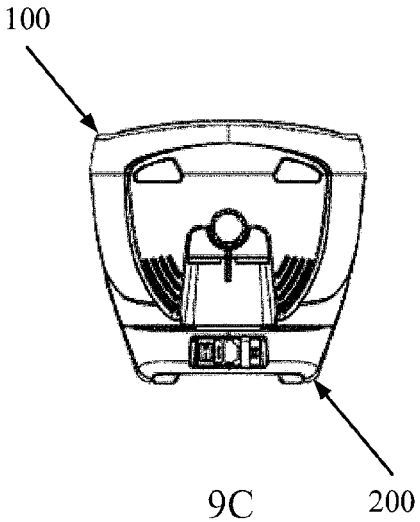
Figure 9C:
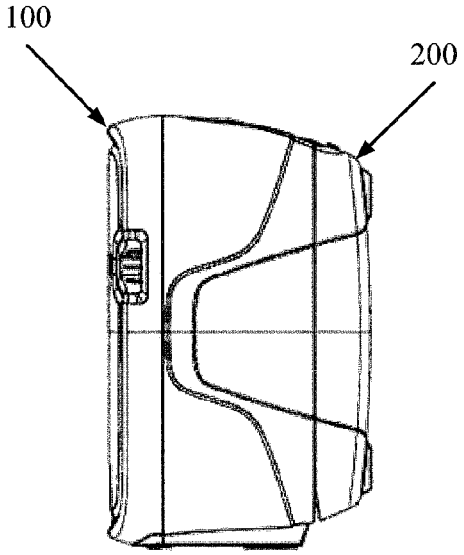
Figure 9D:
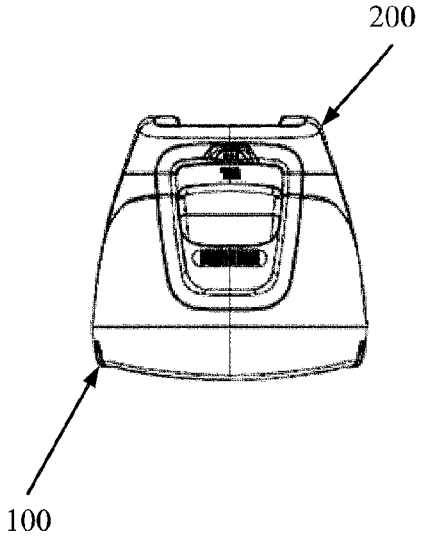

FIGS. 9A-9D illustrate example views of the transportable audio system (i.e., mated speaker-mixer assembly) in accordance with the invention. As shown, FIG. 9A illustrates a rear view of the speaker module 100 and the speaker mating module 200 in the assembled configuration. FIG. 9B illustrates a side view of the speaker module 100 and the speaker mating module 200 in the assembled configuration. FIG. 9C illustrates a bottom view of the speaker module 100 and the speaker mating module 200 in the assembled configuration. FIG. 9D illustrates a top view of the speaker module 100 and the speaker mating module 200 in the assembled configuration.

Figure 10:
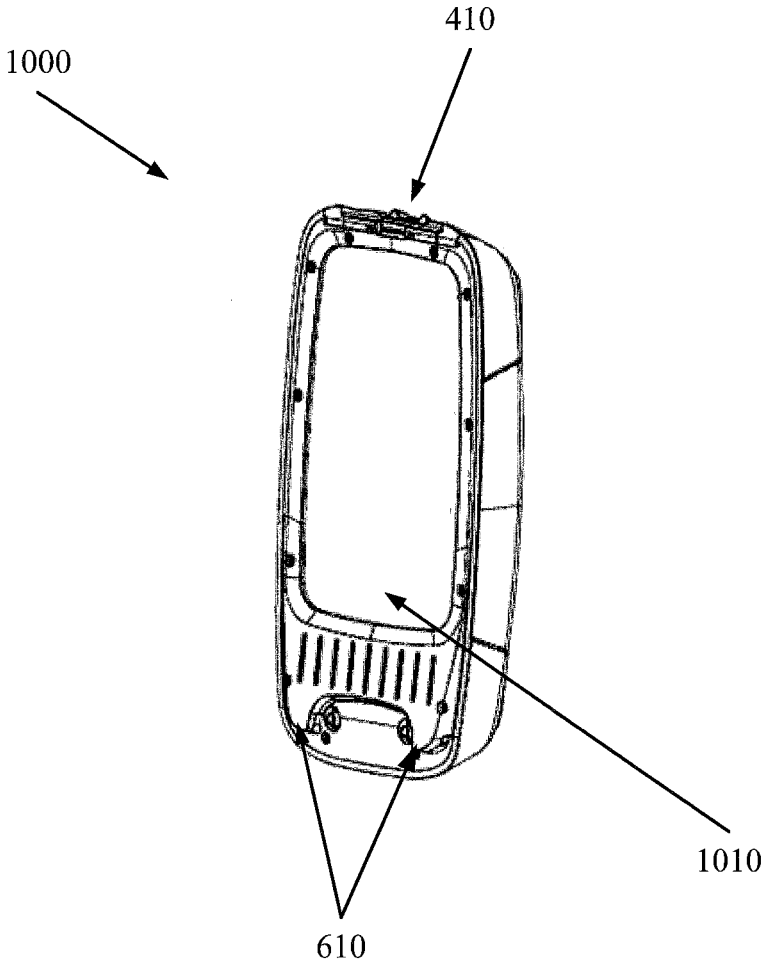
FIG. 10 is a perspective front view of an example of another implementation of a mating back for the speaker shown in FIG. 1 in accordance with the invention.

FIG. 10 illustrates an alternative mating back 1000 for the speaker module 100 in accordance with the invention. As shown, alternative mating back 1000 may be virtually identical to in its form factor to the speaker mating module 200. That is, alternative mating back 1000 may be removably mounted to the speaker module 100 using speaker mating module 200 top latch assembly 410 and mixer bottom tabs 610 in the same way that the speaker mating module 200 may be removably mounted to the speaker module 100. The assemble of alternative mating back 1000 being removably mounted to the speaker module 100 is also shown in FIGS. 9A-9D.

However, alternative mating back 1000 does not contain the mixing functionality that speaker mating module 200 may include. Therefore, alternative mating back 1000 may include an accessible storage cavity (not shown), with a cavity cover 1010 in place of the mixing knobs and connectors as on speaker mating module 200. In this way, alternative mating back 1000 can, for example, store cabling that may be used with the assembly of speaker 100 and speaker mating module 200, along with another combination of speaker module 100 and alternative mating back 1000. This cabling may include two mixer-to-speaker cables (shown in FIG. 3 as items 310) and a power cable for speaker mating module 200 (shown in FIG. 3 as item 330). Thus, two speaker 100 assemblies may include speaker mating module 200 and alternative mating back 1000, along with the cabling necessary for stereo audio reproduction.

While the speaker and mixer assembly has been described in detail and with reference to certain embodiments thereof, it will be apparent to those skilled in the art that various changes and modifications can be made without departing from the spirit and scope of this application. Thus, it is intended that the scope of coverage includes the modifications and variations of the speaker and mixer assembly, provided they come within the scope of the appended claims and their equivalents.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A transportable audio system comprising:

a speaker module including at least one transducer, a backside mating edge, and a backside interior inset from the backside mating edge, the backside mating edge including a first attachment mechanism; and a speaker mating module including a frontside mating edge and a mixer having a frontside face, the frontside mating edge including a second attachment mechanism, the speaker mating module being removably mountable to the speaker module via the first and second attachment mechanisms, wherein at least a portion of the frontside face extends from the speaker mating module beyond the front side mating edge to interact with the at least one transducer, wherein the at least a portion of the frontside face includes at least one of electrical connectors, switches, and knobs to electrically couple the mixer to the at least one transducer.

2. The transportable audio system of claim 1, wherein the first attachment mechanism includes a top hook plate affixed to a top of the backside mating edge, and one or more bottom tab slots on a bottom-side of the backside mating edge.

3. The transportable audio system of claim 1, wherein the second attachment mechanism includes a top latch assembly within a top-side of the frontside mating edge, and one or more bottom tabs on a bottom-side of the frontside mating edge.

4. The transportable audio system of claim 1, wherein the backside interior inset of the speaker module is configured to receive at least a portion of the frontside face from the speaker mating module.

5. The transportable audio system of claim 1, wherein the backside mating edge of the speaker module includes a seal to environmentally seal the at least one transducer when the speaker mating module is mated to the speaker module.

6. The transportable audio system of claim 1, wherein the frontside mating edge of the speaker mating module includes a seal to environmentally seal the mixer when the speaker module is mated to the speaker mating module.

7. The transportable audio system of claim 6, wherein at least a portion of the front side face extends from the seal of the front side mating edge.

8. The transportable audio system of claim 1, wherein the mixer is configured to perform at least one of blending and controlling volume of a number of input signals, adding audio effects, and routing mixed audio signal to a destination.

* * * * *